United States Patent [19]

Nishimura et al.

[11] Patent Number: 5,052,351

[45] Date of Patent: Oct. 1, 1991

[54] DOUBLE OVERHEAD CAMSHAFT BEARING STRUCTURE

[75] Inventors: Kazuaki Nishimura, Hiroshima; Sachiko Nakagawa, Ootake, both of Japan

[73] Assignee: Mazda Motor Corporation, Hiroshima, Japan

[21] Appl. No.: 545,953

[22] Filed: Jul. 2, 1990

[30] Foreign Application Priority Data

Jun. 30, 1989 [JP] Japan ..... 1-168334

[51] Int. Cl.[5] ..... F01L 1/46; F02F 1/24

[52] U.S. Cl. ..... 123/90.27; 123/90.34; 123/90.38; 123/193 H

[58] Field of Search ..... 123/90.27, 90.31, 90.34, 123/90.38, 193 H, 195 C

[56] References Cited

U.S. PATENT DOCUMENTS

| | | | |
|---|---|---|---|
| 4,497,289 | 2/1985 | Bortolussi | 123/90.27 |
| 4,553,510 | 11/1985 | Yano et al. | 123/90.27 |
| 4,607,601 | 8/1986 | Kohler | 123/90.31 |
| 4,840,149 | 6/1989 | Fujita | 123/90.31 |

FOREIGN PATENT DOCUMENTS

| | | | |
|---|---|---|---|
| 0025006 | 2/1984 | Japan | 123/90.38 |
| 0180017 | 10/1984 | Japan | 123/90.27 |
| 0239303 | 10/1988 | Japan | 123/90.34 |
| 0267308 | 10/1989 | Japan | 123/90.27 |
| 2198186 | 6/1988 | United Kingdom | 123/90.27 |

*Primary Examiner*—David A. Okonsky
*Assistant Examiner*—Weilun Lo
*Attorney, Agent, or Firm*—Fleit, Jacobson, Cohn, Price, Holman & Stern

[57] ABSTRACT

A double overhead camshaft engine has a pair of camshafts, interconnected by gearing, which are disposed in juxtaposition over a cylinder head and supported by bearings. Either one of the camshafts is coupled to a crankshaft by a timing belt. A sealing member is disposed between the engine and a front cover so as to sealingly enclose and hide the timing belt. The sealing member, in the form of a rib forming a closed loop, is divided into a plurality of rib segments, at least one of which is formed integrally with the bearing member.

8 Claims, 4 Drawing Sheets

DOUBLE OVERHEAD CAMSHAFT BEARING STRUCTURE

FIELD OF THE INVENTION

The present invention relates to a novel bearing structure for mounting camshafts on a double overhead camshaft engine.

BACKGROUND OF THE INVENTION

One known type of valve drive apparatus, installed in double overhead camshaft engines, uses a timing belt to couple either one of two overhead camshafts, interconnected to each other with a gearing, to an engine crankshaft in order to transmit rotation of the engine crankshaft to the two overhead camshafts so as to open and close intake and exhaust valves at a desired timing.

To protect the timing belt against damage, the engine is provided with a front cover attached thereto to cover and hide the timing belt. This front cover is sealingly secured to the front end of the engine with a seal plate interposed therebetween. The seal plate is configured so as to surround a camshaft pulley attached to the overhead camshaft coupled to the engine crankshaft.

Although such a double overhead camshaft engine always must be as compact as possible and has to be provided with high performance efficiency, the overall length of the engine is increased in order to provide sufficient space, in an axial direction of the camshaft, for the sealing plate to be interposed between the front cover and the front end of a cylinder head of the engine and, in some cases, the front end of a head cover of the engine. Otherwise, if the wall thickness of the cylinder head or the head cover is decreased in an axial direction of the camshaft, in order to provide sufficient space while attempting not to increase the overall length of the engine, supporting structure for the valve drive apparatus may be subjected to a decreased structural rigidity.

SUMMARY OF THE INVENTION

It is, therefore, a primary object of the invention to provide a camshaft bearing structure with high structural rigidity for a double overhead camshaft engine.

It is another object of the invention to provide a camshaft bearing structure for a double overhead camshaft engine which allows a sufficient space for a seal between a front cover and the front end of the engine without increasing the overall length of the engine.

The above objects of the invention are achieved by providing a double overhead camshaft engine having a pair of camshafts which are mounted in juxtaposition over a cylinder head of the engine and interconnected to each other by gearing. Either one of the camshafts is coupled to a crankshaft of the engine by a timing belt. The camshafts are each supported, at one end on the side where the one of the camshafts is coupled to the crankshaft, by a bearing member having two bearing axes in juxtaposition and formed as an integral block. A sealing member is disposed between the engine and a front cover so as to sealingly enclose and hide the timing belt. The sealing member is divided into a plurality of sections, such as rib segments, at least one of which is formed integrally with the bearing member.

BRIEF DESCRIPTION OF THE DRAWINGS

The above and other objects and features of the present invention will be apparent from the following description of a preferred embodiment when considered in conjunction with the appended drawings, in which.

DESCRIPTION OF THE PREFERRED EMBODIMENT

Figure 1:
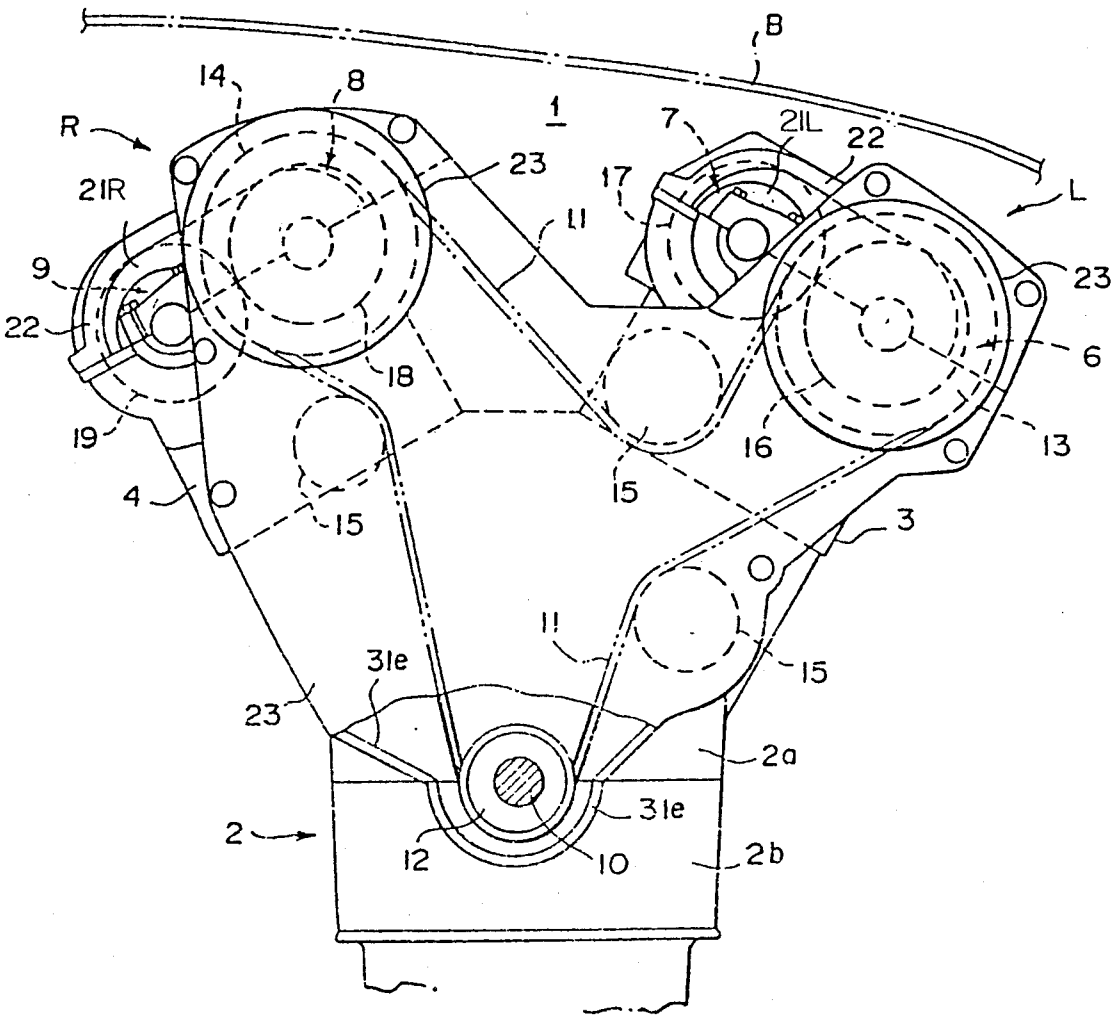
FIG. 1 is a schematic front view showing partially a double overhead camshaft engine with a camshaft bearing structure in accordance with a preferred embodiment of the present invention.
Figure 2:
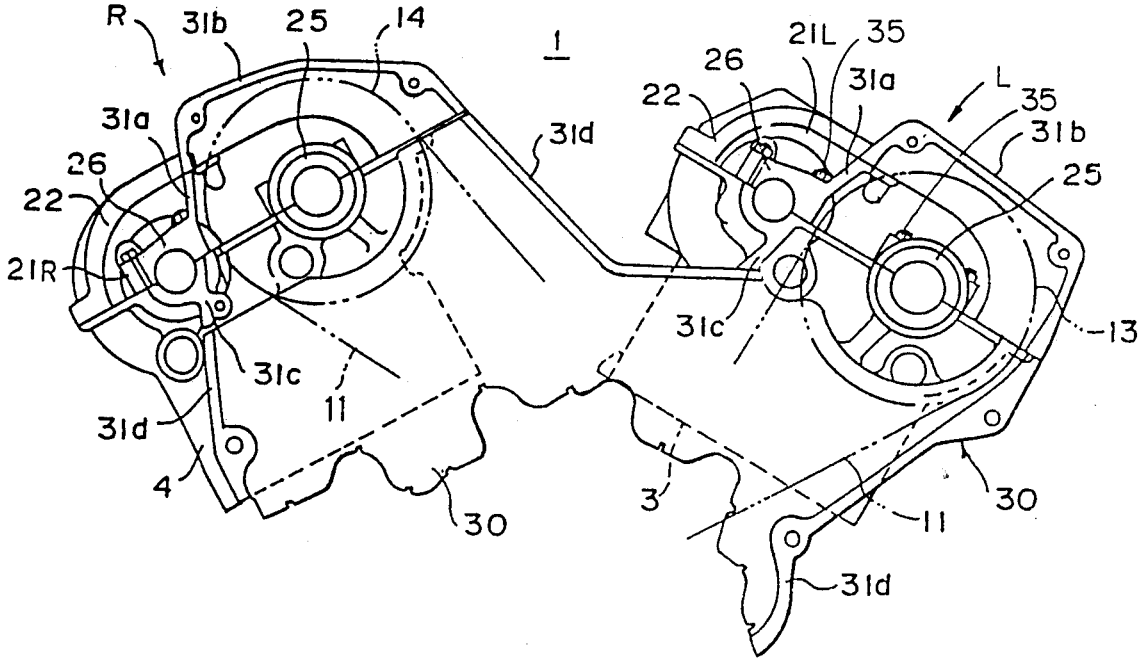
FIG. 2 is a schematic, enlarged front view showing partially the double overhead camshaft engine with a front cover detached.
Figure 3:
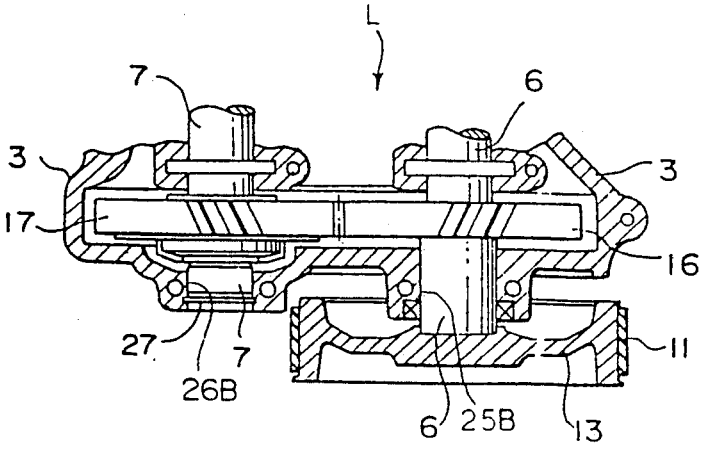
FIG. 3 is a plan view, partially in cross-section, showing partially the double overhead camshaft engine with its head cover detached.

Referring to the drawings in detail, particularly to FIGS. 1 to 3, an engine body of a V-type internal combustion engine having a camshaft bearing structure in accordance with a preferred embodiment of the present invention is generally indicated by a reference numeral 1. The engine body 1 includes left or first and right or second cylinder banks L and R arranged in a V-formation with a predetermined relative angle therebetween, for example, a relative angle of 60 degrees. A plurality of, for example six, cylinders are divided into two groups, and the cylinders in each group are disposed in one and the same cylinder bank L or R, respectively, so that adjacent cylinders in each bank, L or R, do not fire one after another.

The engine 1 has a cylinder block 2 consisting of upper and lower half blocks 2*a* and 2*b*. A left or first cylinder head 3 is mounted on the cylinder block 6 and provided for the left cylinder block L, and a right or second cylinder head 4 is mounted on the cylinder block 6 and provided for the right cylinder block R.

A valve drive mechanism includes four overhead camshafts, namely first and second camshafts 6 and 7 juxtaposed over the left cylinder head 3 and third and fourth camshafts 8 and 9 juxtaposed over the left cylinder head 4. The second and third camshafts 7 and 8 are operated to timely, i.e., sequentially, open and close intake valves (not shown) and the first and fourth camshafts 6 and 9 are operated to timely open and close exhaust valves (not shown). The first exhaust camshaft 6 extends parallel to a crankshaft 10 and projects from the left cylinder head 3. The third, intake camshaft 8 extends parallel to a crankshaft 10 and projects from the right cylinder head 4. The first, exhaust camshaft 6 and third, intake camshaft 8 are coaxially secured on the ends of the parts thereof projecting from the cylinder heads 3 and 4, respectively, to camshaft pulleys 13 and 14, respectively. These camshaft pulleys 13 and 14 have the same diameter and are connected or coupled to a crank pulley 12 of the crankshaft 10 by a timing belt 11. Belt 11 transmits the engine output to drive the camshaft pulleys 13 and 14, so as to rotate the camshafts 6 and 8 at the same speed and in the same direction. An appropriate number of, for instance three, idle pulleys 15 are disposed to exert an appropriate tension on the timing belt 11.

The second, intake camshaft 7 is shorter in length than the first, exhaust camshaft 6 and extends parallel to the crankshaft 10. The second, intake camshaft 7 is provided with a helical gear 17 in mesh with a helical gear 16 fixedly mounted on the first, exhaust camshaft 6 so that the second, intake camshaft 7 rotates at the same speed of rotation as, but in the opposite direction to, the first, exhaust camshaft 6. The fourth, exhaust camshaft 9 is shorter in length than third, intake camshaft 8 and extends parallel to the crankshaft 10. The fourth, exhaust camshaft 9 is provided with a helical gear 19 in mesh with a helical gear 18 fixedly mounted on the third, intake camshaft 6 so that the fourth, exhaust camshaft 9 rotates with the same speed of rotation as, but in the opposite direction to, the third, intake camshaft 8.

The camshafts 6 and 7 are mounted, at the parts of their ends to which the helical gears 16 and 17 are secured, on the left cylinder head 3 by an integral bearing block 21L. The camshafts 8 and 9 are mounted, at the parts of their ends to which the helical gears 18 and 19 are secured, on the right cylinder head 4 by an integral bearing block 21R. Between each integral bearing block 21L and 21R and cylinder head 3 and 4, respectively, are formed two bearing bores 25 and 26, in juxtaposition, with bearing axes parallel to the crankshaft 10. The cylinder heads 3 and 4 including the camshafts 6 to 9 are concealed by top covers 22, respectively. The camshaft pulleys 13 and 14, crankshaft pulley 12 and timing belt 11 coupling these pulleys are concealed by a front cover 23.

Figure 4:
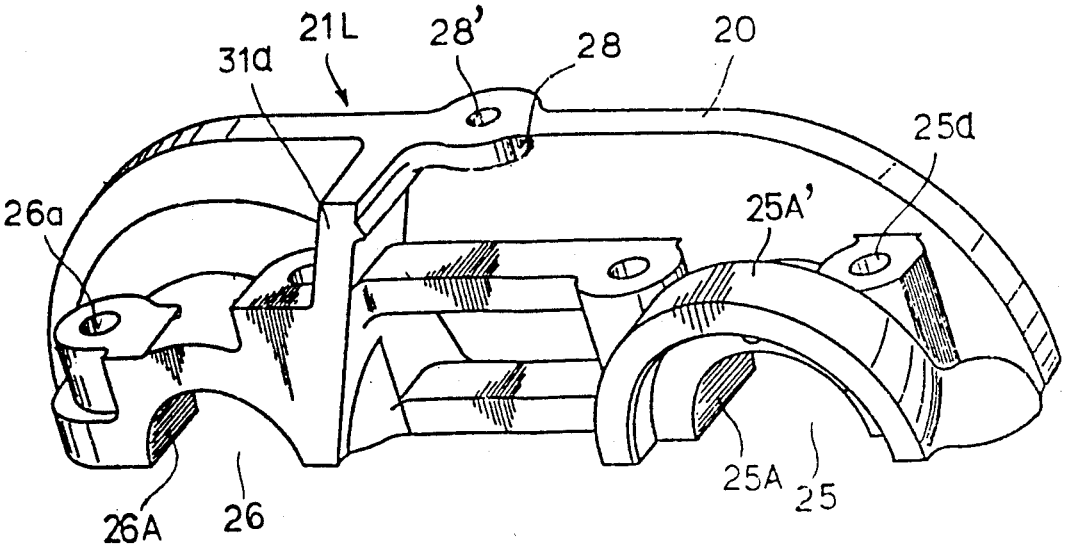
FIG. 4 is a perspective view showing a bearing block of the double overhead camshaft engine shown in FIG. 1.
Figure 5:
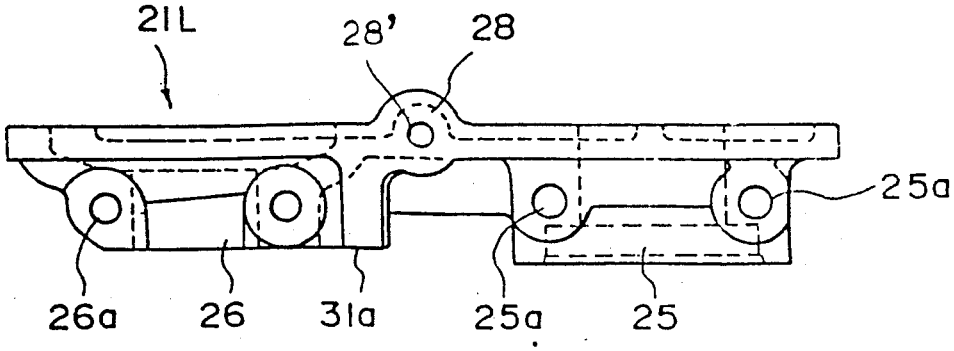
FIG. 5 is a plan view of FIG. 4.

Referring to FIGS. 4 and 5, details of the integral bearing blocks 21L and 21R are shown. Because the integral bearing blocks 21L and 21R are identical in structure to each other, the following description will be directed to the integral bearing block 21L for the camshafts 6 and 7 arranged over the left cylinder head 3 only. As is shown, the integral bearing block 21L is formed with a vertical flange 20, having a substantially trapezoidal configuration, and first and second upper bearing halves 25A and 26A providing bearing surfaces and extending in a direction of the axis of rotation of the camshafts 6 and 7 from the vertical flange 20. The first upper bearing half 25A is integrally formed with an axially extending semi-circular flange or brim 25A'. The left cylinder head 3 is formed with first and second semi-circular recesses 25B and 26B serving as lower bearing halves. The integral bearing block 21L is mounted on the left cylinder head 3 to form first and second camshaft bearing bores 25 and 26 between the first and second, upper and lower bearing halves 25A and 26A and 25B and 26B as shown in FIG. 3. To firmly but rotatably hold the first and second camshafts 6 and 7, the bearing block 21L is formed with two through bores **25*a* or 26*a* located on both sides of each upper bearing half 25A or 26A, through which the bearing block 21L is secured to the left cylinder head 3 by bolts 35. The bearing block 21L is integrally formed with a sealing rib segment 31*a* extending from the laterally inner side of the second bearing half 26A toward the first upper bearing half 25A and has a top surface even with the top surface of the vertical flange 20. The bearing block 21L is further formed, at the middle of the vertical flange 20, with a boss 28 having a through bore 28' through which a bolt is inserted to fasten the head cover 22**.

As is understood from FIGS. 2 and 3, the first bearing bore 25, formed by and between the first upper and lower bearing halves 25A and 25B, rotatably holds the part of one end of the first, exhaust camshaft 6. The camshaft pulley 13 is secured to the end of the first, exhaust camshaft 6 projecting from the camshaft bearing block 21L and placed in the axial direction between the axial flange 25A' of the first upper bearing half 25A and the front cover 23. The second bearing bore 26, also formed by and between the second upper and lower bearing halves 26A and 26B, rotatably holds the part of the one end of the second, intake camshaft 7 and is firmly plugged up by a stop 27.

Figure 6:
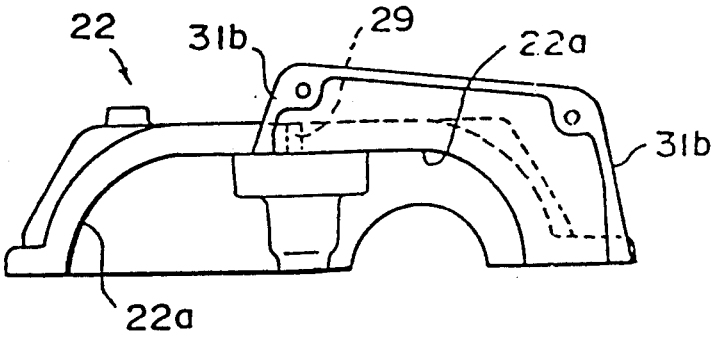
FIG. 6 is a front view showing the head cover of the double overhead camshaft engine shown in FIG. 1.
Figure 7:
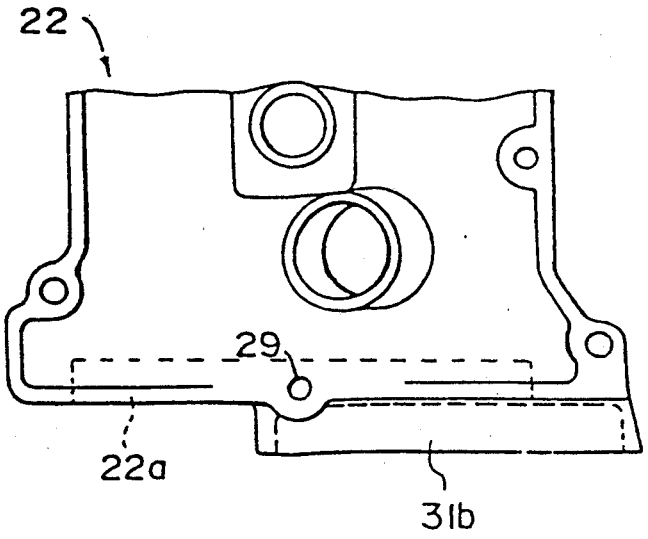
FIG. 7 is a plan view of the head cover FIG. 6.

Referring to FIGS. 6 and 7, details of each head cover 22 are partly shown. Because the head covers 22 for the left and right cylinder heads 3 and 4 are identical in structure to each other, the following description is directed to one of the head covers, namely the head cover 22 for the left cylinder head 3, only. The front part of the head cover 22 has a front end recess **22*a* having the same configuration as the contour of the vertical flange 20 of the camshaft bearing block 21L so as to firmly fit and hold down the camshaft bearing block 21L. The front part of the head cover provides the front end of the first or left cylinder bank L by attaching the head cover 22 to the first cylinder head 3 via a fastening bolt (not shown) inserted through a bore 29 formed in the head cover 22 and the bore 28' formed in the bearing block 21L and a nut (not shown). The head cover 22 is formed with a sealing rib segment 31*b* projecting in the axial direction therefrom and surrounding or encircling the camshaft pulley 13 when the head cover 22 is attached to the first cylinder head 3. The sealing rib segment 31*b* has one side with a lower end which is located on the top of the sealing rib segment 31*a* of the bearing block 21L**.

To provide a positive oil seal between the front cover 23 and the first cylinder bank L, a closed loop sealing rib is formed by the sealing rib segments **31*a* and 31*b*, a sealing rib segment 31*c*, sealing rib segments 31*d*, integrally formed with a sealing or engine front plate 30 overlapped on the front ends of the first and second cylinder heads 3 and 4, and sealing rib segments 31*e* (see FIG. 1) integrally formed, on their front end surfaces, with the first cylinder head 3. The front cover 23 is secured to the closed sealing rib loop, consisting of the rib segments 31*a*–31*e***, with a rubber sealing gasket (not shown) interposed therebetween.

Since the closed sealing rib loop is divided into several, for instance five, in this embodiment, sealing rib segments **31*a* through 31*e* and the sealing rib segments 31*a* to 31*c* are integral with each bearing block 21L, 21R, the head covers 22 and the cylinder heads 3 and 4, respectively, and no element or member like the front sealing plate 30 is provided adjacent to the front of the head cover 22, it is not necessary to increase the overall length of the engine body 1 in an axial direction of the camshaft in order to provide a sufficient space for the closed sealing rib loop. The engine body 1 is therefore made compact. Furthermore, the integral bearing block 21 with the integral sealing rib segment 31*a*, which is provided as one block, supports both of the overhead camshafts 6 and 7 or 8 and 9**, and an improved holding or bearing rigidity is obtained.

The overhead camshaft bearing structure of the present invention may be embodied in any type of double overhead camshaft engine, such as in a V-type or an in-line overhead camshaft engine, with the same results.

It is to be understood that although the invention has been described in detail with respect to a preferred embodiment thereof, nevertheless, various other embodiments and variants are possible which fall within the spirit and scope of the invention, and such are intended to be covered by the following claims.

What is claimed is:

1. A camshaft bearing structure for a double overhead camshaft engine having a pair of camshafts mounted in juxtaposition over a cylinder head of said double overhead camshaft engine and interconnected to each other by gearing, one of said pair of camshafts being coupled to a crankshaft of said double overhead camshaft engine by a timing belt, said camshaft bearing structure comprising:

a bearing member for retaining each of said pair of camshafts at one end thereof on a side where said one of said pair of camshafts is coupled to said crankshaft, said bearing member having two bearing axes in juxtaposition and being formed as an integral block;

a front cover attached to a front end of said double overhead camshaft engine so as to cover and hide said timing belt; and a sealing means disposed between said front end of said double overhead camshaft engine and said front cover so as to sealingly encircle said timing belt, said sealing means being at least in part formed integrally with a front surface of said bearing member.

2. A camshaft bearing structure as defined in claim 1, wherein said bearing member is formed so as to have an upper half of a bearing bore for each said camshaft, and a top surface of said cylinder head is formed with a lower half of said bearing bore for each said camshaft, said bearing member being disposed on said top surface of said cylinder head formed with the lower half of said bearing bore so that said bearing structure bears each said camshaft from upper and lower sides.

3. A camshaft bearing structure as defined in claim 2, wherein said sealing means is formed by a plurality of rib segments connected in a closed loop.

4. A camshaft bearing structure as defined in claim 3, wherein said part of said sealing means is a sealing rib segment directed so as to extend substantially in the same direction as part of said timing belt which passes between said two bearing axes.

5. A camshaft bearing structure as defined in claim 3, wherein part of said sealing means is a sealing rib segment directed so as to extend in a direction substantially perpendicular to a line connecting said two bearing axes.

6. A camshaft bearing structure as defined in claim 3, wherein said double overhead camshaft engine further has a cylinder head cover covering said pair of camshafts, said cylinder head cover being integrally formed with a sealing rib segment serving as part of said sealing means.

7. A camshaft bearing structure as defined in claim 6, wherein said bearing member is formed with a boss with a bore located inside said sealing means for providing part of means interconnecting said bearing member and said cylinder head cover.

8. A camshaft bearing structure as defined in claim 1, wherein said double overhead camshaft engine is a V-type engine.

* * * * *